US010112768B2

(12) United States Patent
Albisetti

(10) Patent No.: US 10,112,768 B2
(45) Date of Patent: Oct. 30, 2018

(54) HOLLOW DISPENSING HEAD

(71) Applicant: L'OREAL, Paris (FR)

(72) Inventor: Nicolas Albisetti, Saint Gratien (FR)

(73) Assignee: L'OREAL, Paris (FR)

( * ) Notice: Subject to any disclaimer, the term of this patent is extended or adjusted under 35 U.S.C. 154(b) by 308 days.

(21) Appl. No.: 14/370,426

(22) PCT Filed: Jan. 3, 2013

(86) PCT No.: PCT/IB2013/050056

§ 371 (c)(1),
(2) Date: Jul. 2, 2014

(87) PCT Pub. No.: WO2013/102865

PCT Pub. Date: Jul. 11, 2013

(65) Prior Publication Data

US 2015/0014443 A1 Jan. 15, 2015

Related U.S. Application Data

(60) Provisional application No. 61/604,893, filed on Feb. 29, 2012.

(30) Foreign Application Priority Data

Jan. 3, 2012 (FR) ..... 12 50039

(51) Int. Cl.
*B65D 83/30* (2006.01)
*B05B 1/06* (2006.01)
(Continued)

(52) U.S. Cl.
CPC ..... *B65D 83/30* (2013.01); *B05B 1/06* (2013.01); *B05B 1/3447* (2013.01); *B05B 7/063* (2013.01);
(Continued)

(58) Field of Classification Search
CPC ..... B05B 1/3447; B05B 7/063; B05B 7/065; B05B 1/207; B05B 7/061; B05B 7/067; B05B 1/00–1/36; B65D 83/14–83/759
(Continued)

(56) References Cited

U.S. PATENT DOCUMENTS 2,681,254 A 6/1954 Fuller
2,785,926 A 3/1957 Lataste
(Continued)

FOREIGN PATENT DOCUMENTS

CH 596888 A5 3/1978
CN 2 873 317 Y 2/2007
(Continued)

OTHER PUBLICATIONS

Non-Final Office Action dated Apr. 6, 2016 from U.S. Appl. No. 14/370,424.
(Continued)

*Primary Examiner* — Steven J Ganey
*Assistant Examiner* — Juan C Barrera
(74) *Attorney, Agent, or Firm* — Jones Robb, PLLC

(57) ABSTRACT

Dispensing head (1) intended to be fitted on a container that contains at least one product to be dispensed, this dispensing head comprising:

a body (3) that is open at its two opposite axial ends, an engaging part (10) that is open at its two opposite axial ends, at least partially defining a dispensing orifice.

42 Claims, 6 Drawing Sheets

(51) Int. Cl.

| | |
|---|---|
| ***B65D 83/20*** | (2006.01) |
| ***B65D 83/28*** | (2006.01) |
| ***B05B 1/34*** | (2006.01) |
| ***B05B 7/08*** | (2006.01) |
| *B05B 1/20* | (2006.01) |
| *B05B 7/06* | (2006.01) |

(52) U.S. Cl.
CPC ..... *B05B 7/065* (2013.01); *B05B 7/0892* (2013.01); *B65D 83/20* (2013.01); *B65D 83/28* (2013.01); *B05B 1/207* (2013.01); *B05B 7/061* (2013.01)

(58) Field of Classification Search
USPC .... 239/337, 310, 314, 315, 550, 419.5, 424; 222/402.1–402.2, 567, 570
See application file for complete search history.

(56) References Cited

U.S. PATENT DOCUMENTS

| | | | | |
|---|---|---|---|---|
| 2,913,749 | A | 11/1959 | Ayres | |
| 3,462,085 | A | 8/1969 | Nugarus | |
| 3,767,125 | A * | 10/1973 | Gehres | B65D 83/20 239/552 |
| 4,592,509 | A * | 6/1986 | Moss | B05B 1/005 239/424 |
| 5,215,260 | A * | 6/1993 | Robbins | B05B 1/06 239/590.5 |
| 5,273,191 | A * | 12/1993 | Meshberg | B05B 11/0018 222/105 |
| 5,297,739 | A * | 3/1994 | Allen | A46B 17/06 239/530 |
| 5,617,978 | A | 4/1997 | Geier | |
| 5,730,332 | A * | 3/1998 | Zimmerhackel | B05B 7/0068 222/148 |
| 6,257,503 | B1 | 7/2001 | Baudin | |
| 6,338,442 | B1 | 1/2002 | De Laforcade | |
| 7,500,621 | B2 * | 3/2009 | Tryon | B05B 1/1654 222/402.1 |
| 7,950,597 | B2 | 5/2011 | Vanblaere et al. | |
| 2003/0158527 | A1 | 8/2003 | Mezzoli | |
| 2008/0001006 | A1 * | 1/2008 | Monterrosa | B05B 15/0456 239/288.5 |
| 2009/0060710 | A1 * | 3/2009 | Gammack | F04D 25/06 415/90 |
| 2010/0150699 | A1 * | 6/2010 | Nicolas | F04D 25/08 415/90 |
| 2010/0225012 | A1 * | 9/2010 | Fitton | F24F 1/01 261/116 |
| 2012/0234947 | A1 | 9/2012 | Takahashi | |

FOREIGN PATENT DOCUMENTS

| | | | |
|---|---|---|---|
| CN | 201 558 753 | U | 8/2010 |
| DE | 296 22 069 | U1 | 3/1997 |
| EP | 1035038 | A1 | 9/2000 |
| EP | 1 052 023 | A1 | 11/2000 |
| GB | 1 009 170 | A | 11/1965 |
| WO | 02/07894 | A1 | 1/2002 |
| WO | 2011/065413 | A1 | 6/2011 |

OTHER PUBLICATIONS

International Search Report and the Written Opinion of the International Searching Authority, International Application No. PCT/IB2013/050056 dated Mar. 25, 2013.
Preliminary Search Report and Written Opinion dated Jul. 8, 2014 for International Application No. PCT/IB2013/050056.
French Preliminary Search Report for French Application No. FR 12 50039 dated Jun. 18, 2014, with machine-generated English translation.
International Search Report and the Written Opinion of the International Searching Authority, International Application No. PCT/IB2013/050059.
Non-Final Office Action dated Apr. 9, 2015 from U.S. Appl. No. 14/370,424.
Final Office Action dated Oct. 28, 2015 from U.S. Appl. No. 14/370,424.

* cited by examiner

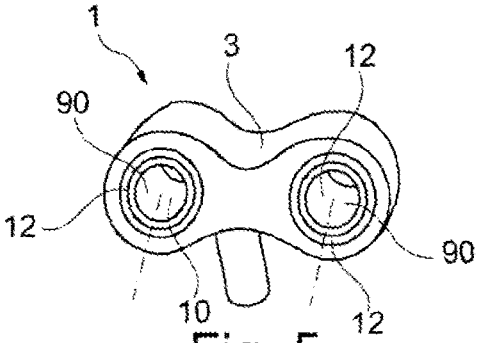
Fig. 5
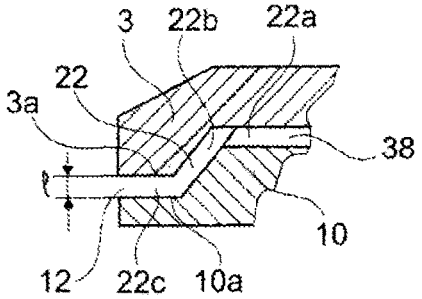
Fig. 4B
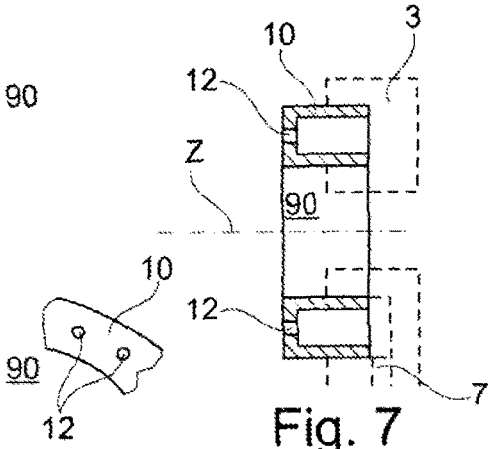
Fig. 8A
Fig. 7
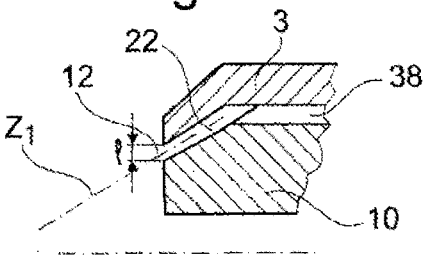
Fig. 4C
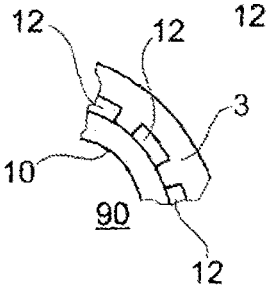
Fig. 10A
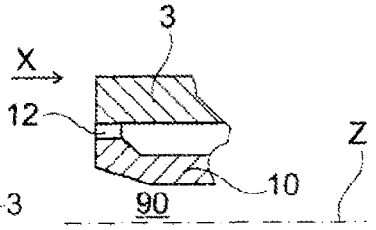
Fig. 9
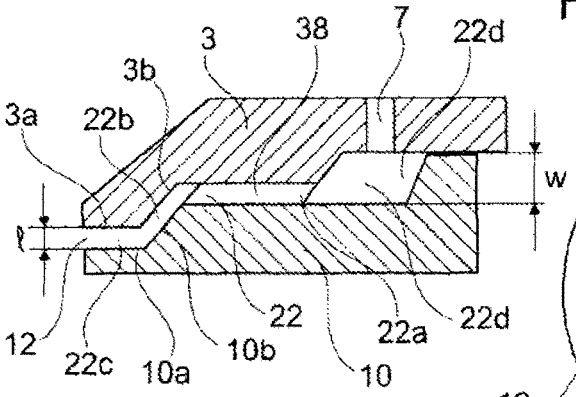
Fig. 4A
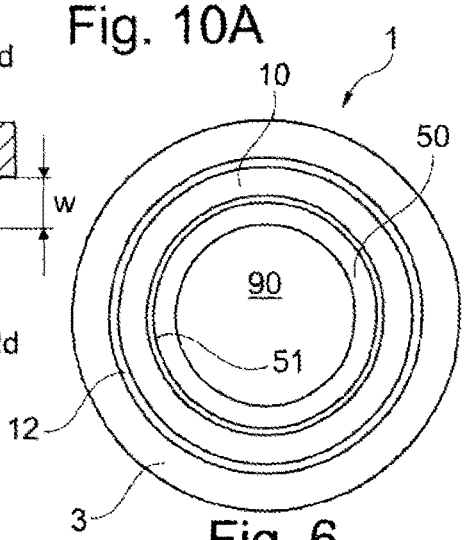
Fig. 6

HOLLOW DISPENSING HEAD

This is a national stage application of PCT/IB2013/050056, filed internationally on Jan. 3, 2013, which claims priority to French Application No. FR 1250039, filed Jan. 3, 2012, and U.S. Provisional Application No. 61/604,893, filed Feb. 29, 2012, the entire disclosures of each of which are incorporated herein by reference.

The present invention relates to dispensing heads used for dispensing a product contained in a container, in particular for spraying it.

The invention relates more particularly, but not exclusively, to spray heads intended to be fitted on pressurized containers that contain cosmetic products.

Numerous spray heads have been proposed, having one or more dispensing orifice(s). Numerous parameters should be taken into consideration when designing a spray head.

First of all, the spray generated should have the granulometry suitable for the application. In this respect, the size of the droplets should not be too small or too large.

Furthermore, the spray generated should be delivered at the flow rate required and the spray head should not subject the flow of product to an excessive pressure drop.

The form of the spray should likewise correspond to the intended application and thus make it possible, as the case may be, to cover a more or less extensive area.

Finally, the spray head should be aesthetically pleasing to the consumer, and its manufacture should be compatible with the requirements of large-scale production.

The invention aims to propose a novel dispensing head which is very particularly suitable for spraying a cosmetic product.

Application EP 1 052 023 A1 discloses a spray head comprising a dispensing orifice defined between a closure member having a frustoconical part and the body of the head. The closure member is opened by deformation of the frustoconical part, under the pressure of the product during dispensing. A conical and hollow spray is formed at least in the vicinity of the head.

Application WO 2011/065413 discloses various arrangements of spray heads in which a spray orifice is defined between a peripheral part and a central part which are connected together by bridges of material.

The subject of the invention, according to a first of its aspects, is a dispensing head intended to be fitted on a container that contains at least one product to be dispensed, this dispensing head comprising:

- a body that is open at its two opposite axial ends,
- an engaging part that is open at its two opposite axial ends, at least partially defining a dispensing orifice.

In particular, the dispensing orifice is preferably defined between the body and the engaging part but may, alternatively, be defined entirely by the engaging part.

By virtue of the invention, a passage is formed through the dispensing head and more particularly through the body and the engaging part, allowing a flow of air to be established through the head when the product to be dispensed is emitted, and this can prove advantageous when the product is emitted in the form of a spray, allowing a current of air to be created through the head in order to accompany the flow of the spray.

In addition, the dispensing head has an appearance which contrasts clearly with the usual aesthetics of known dispensing heads, and which proves to be particularly attractive to the consumer.

Furthermore, the passage through the head can be produced with dimensions sufficient to allow, if desired, a finger or a lock of hair to be inserted into this passage. This can make it easier to apply a product to the finger or the lock of hair.

If desired, the invention can also make it easier to produce a dispensing orifice having an annular section between the engaging part and the body, allowing the formation of a hollow spray. Alternatively, a plurality of dispensing orifices are formed between the body and the engaging part, for example in order to dispense the product in the form of a number of sprays or jets. The number of dispensing orifices may especially be 10 or more, better 20 or more, and even better 30 or more. Each of the dispensing orifices have, for example, a cross-sectional area of 0.003 $mm^2$ or more, preferably 0.006 $mm^2$ or more, and are preferably spaced apart by a space (measured along a straight line between orifice barycentres) of more than 1 mm.

In another variant, a plurality of dispensing orifices are entirely formed in the engaging part. The orifices may be constructed in such a way that the jet exiting from each orifice swirls, especially by virtue of at least two swirling ducts oriented tangentially around the axis of the orifice. The engaging part may have a U-shaped axial half-section. The body may have two concentric mounting skirts between which the engaging part is fastened. The body may comprise a crown into which the engaging part is inserted, the crown possibly bearing one or more reliefs defining, with the engaging part, ducts, especially swirling ducts, for supplying the dispensing orifice.

The body may define a housing that receives the engaging part, which is then called a core.

The one or more dispensing orifices may be open at rest. The expression "at rest" should be understood as meaning before the engaging part is exposed to the pressure of the product to be dispensed. Thus, in this case, the one or more dispensing orifices are already formed and open when the product is sent into the head in order to be dispensed. Alternatively, the dispensing orifice is formed at the time the product is dispensed, by virtue for example of the elasticity of at least a portion of the body or of the engaging part, which deforms under the pressure of the product at the time it is dispensed.

By virtue of the invention, in the case of spraying, the spray can be emitted at a relatively high flow rate, if desired, while having a spray head which has a relatively simple design and functions reliably. In particular, the dispensing orifice may be produced with well-defined dimensions. In addition, the dispensing head may be aesthetically pleasing to the consumer.

The body may have a first surface that flares towards the outside, or converges towards the outside, and the engaging part may have a second surface, opposite the first surface, that diverges towards the outside, or converges towards the outside. The first surface may be conical. The second surface may be conical, with the same angle as the first surface or with a greater or smaller angle.

A different angle, which results in a widening of the space formed between the engaging part and the body on moving towards the dispensing orifice, may prove to be preferable in the case of the dispensing of a foam, in order to allow the latter to expand and to slow down before it leaves through the dispensing orifice.

A different angle that results in a narrowing of the space may lead to an acceleration of the jet before it exits, and this may be advantageous in the context of a spray.

There may be one or more than one dispensing orifice and it may have an annular shape or some other shape. The dispensing orifice may have a constant width in the circumferential direction. The one or more dispensing orifices may be defined between two concentric surfaces of revolution, for example in the form of cylinders of revolution.

The one or more dispensing orifices may have axial symmetry, preferably rotational symmetry, in particular around the dispensing axis. The dispensing axis is defined by the general direction in which the product is dispensed by the head.

The engaging part is preferably attached, thereby making it, and the body, easier to manufacture. Alternatively, the engaging part is moulded as one part with the body, in particular in the case of the dispensing of a foam, it then being possible for the dispensing orifice to have a larger section than in the case of the spraying of a spray.

The space formed between the body and the engaging part is supplied by at least one supply duct, the section of which is preferably greater than that of the dispensing orifice, thereby making it easier to fill this space before the product emerges through the dispensing orifice.

A product distribution chamber may advantageously be formed, between the engaging part and the body, upstream of the dispensing orifice. This can make the emission of a homogeneous spray, in particular, easier.

The supply duct for the product may open into this chamber, which preferably has an annular shape. Its width, which corresponds to the gap between the engaging part and the body, is preferably greater than the maximum width of the passage, via which the distribution chamber communicates with the dispensing orifice.

At least one of the body and the engaging part, preferably the body, may have at least one relief for centring the engaging part in relation to the body, and preferably at least ten, better still at least twenty, and even better still at least forty. These reliefs may extend as far as the edge of the part in which they are produced so as to generate a multitude of orifices via which jets of product exit, the centring reliefs especially being oriented parallel to the dispensing axis or obliquely in the same circumferential direction around the axis, and also possibly defining, between one another, sectional narrowings that cause the jets of product to be accelerated. This or these reliefs are preferably located set back from the dispensing orifice when it is desired to generate a spray in the form of a single jet. The reliefs can be produced on the body, being for example in the form of axial ribs that are distributed regularly around the entire surface of the body opposite the engaging part.

The centring reliefs may optionally ensure alone that the engaging part is held on the body. Alternatively, the engaging part is fixed to the body somewhere other than in the region of the centring reliefs, it being possible in this case for the centring reliefs to have or not have a function of holding the engaging part on the body.

Preferably, the engaging part is fixed in relation to the body. Alternatively, the engaging part is fixed in an adjustable manner in relation to the body, in order for example to allow the user to adjust the width of the dispensing orifice or to close the latter when not in use, for example by screwing it through a quarter turn, this screwing being accompanied by an axial movement of the engaging part in relation to the body.

The engaging part may lie flush with the front end of the body so as to generate a spray with an axis substantially parallel to the axis of the engaging part.

The engaging part may extend axially beyond the front end of the body by an amount lying between 0 and 1 mm, and better still between 0 and 0.5 mm. The spray may then diverge away from axis of the engaging part.

The engaging part may be axially set back from the front end of the body by an amount lying between 0 and 1 mm, and still better between 0 and 0.5 mm. The spray may then converge towards the axis of the engaging part.

The invention makes it possible to easily produce, if desired, a dispensing orifice having a circular internal contour. The inside diameter of the passage formed through the head is for example greater than or equal to 10 mm, better still 15 mm, 20 mm or 30 mm. When the passage does not have a circular section, the "inside diameter" designates the diameter of the largest circle inscribed in this passage.

The head may comprise at least two housings and two engaging parts that are disposed in the housings and each define with the body, at rest, a dispensing orifice according to the invention. The dispensing axes may then be parallel or not parallel, intersecting or not intersecting, for example converging towards one another.

The dispensing orifice may have, in axial half section, an axis that converges or diverges in relation to the spraying direction.

A further subject of the invention, according to another of its aspects, is a container provided with a dispensing head according to the invention.

The product may be a cosmetic product to be dispensed in the form of a spray or of a foam.

The container may be a pressurized container, provided for example with a hollow valve rod inserted into a housing in the head that is suitable for holding said rod.

The invention may be better understood from reading the following detailed description of non-limiting illustrative embodiments thereof and from examining the appended drawings, in which:

FIG. 1 schematically shows a perspective view of an example of a dispensing head produced in accordance with the invention, before the engaging part is fitted on the body of the head, FIG. 2 shows the dispensing head after the engaging part has been fitted in the body, FIG. 3 is a view similar to FIG. 1 in partial section, FIGS. 4A to 4F illustrate variant arrangements, among others, of the engaging part and the body, FIG. 5 illustrates the possibility of producing the dispensing head with two dispensing orifices according to the invention, FIG. 6 shows a front view of a dispensing head having concentric dispensing orifices, FIG. 7 is an axial section through a variant embodiment of the engaging part, FIGS. 8A and 8B are front partial views of variant configurations of the engaging part shown in FIG. 7;

FIG. 9 is a partial axial section through a variant embodiment of the dispensing orifice, FIGS. 10A and 10B are front views along X of variant configurations in accordance with FIG. 9;

Figure 1:
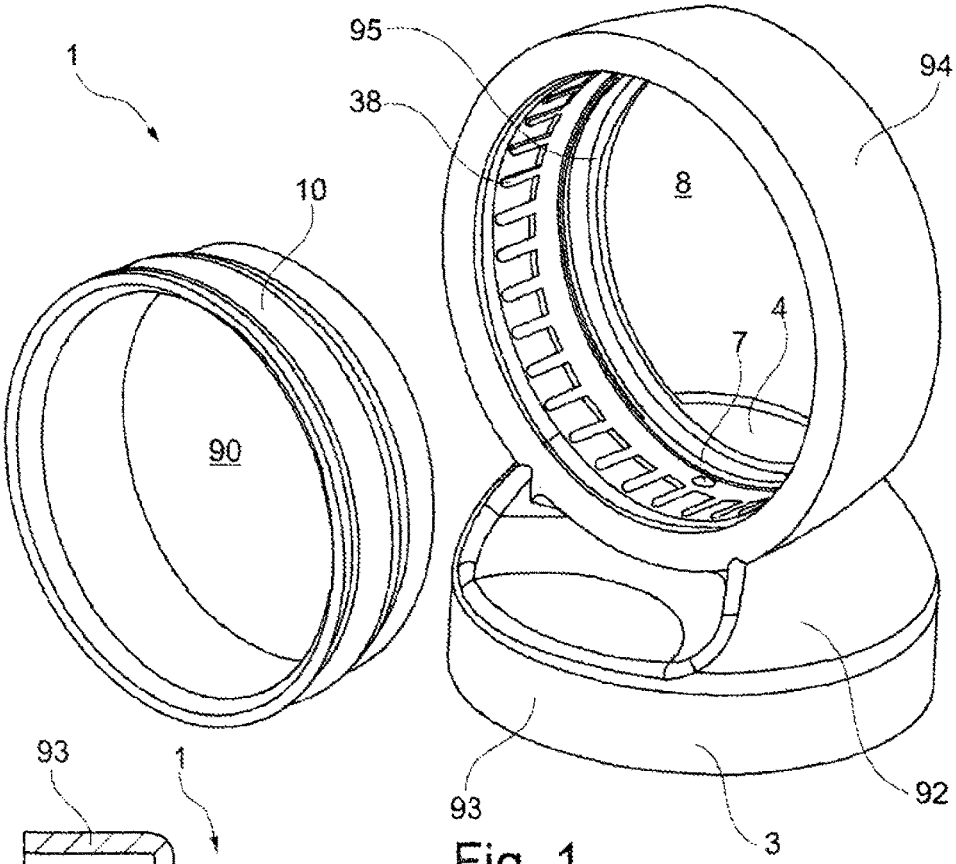

In the drawing, the actual respective proportions of the various constituent elements have not always been respected, for the sake of clarity.

Figure 2:
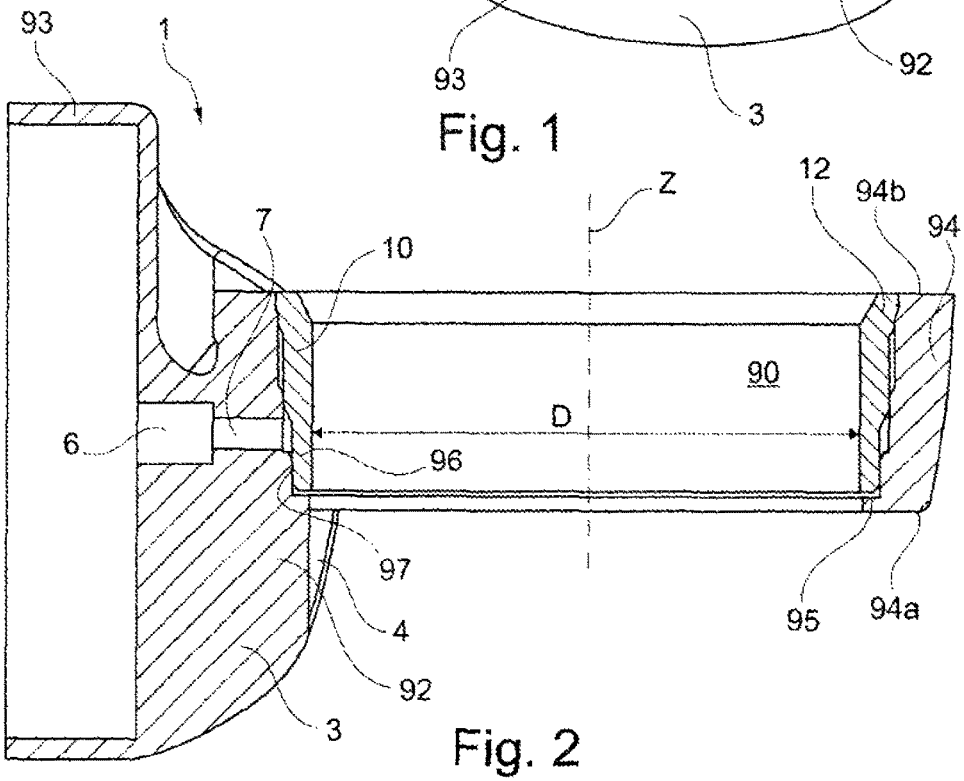
Figure 3:
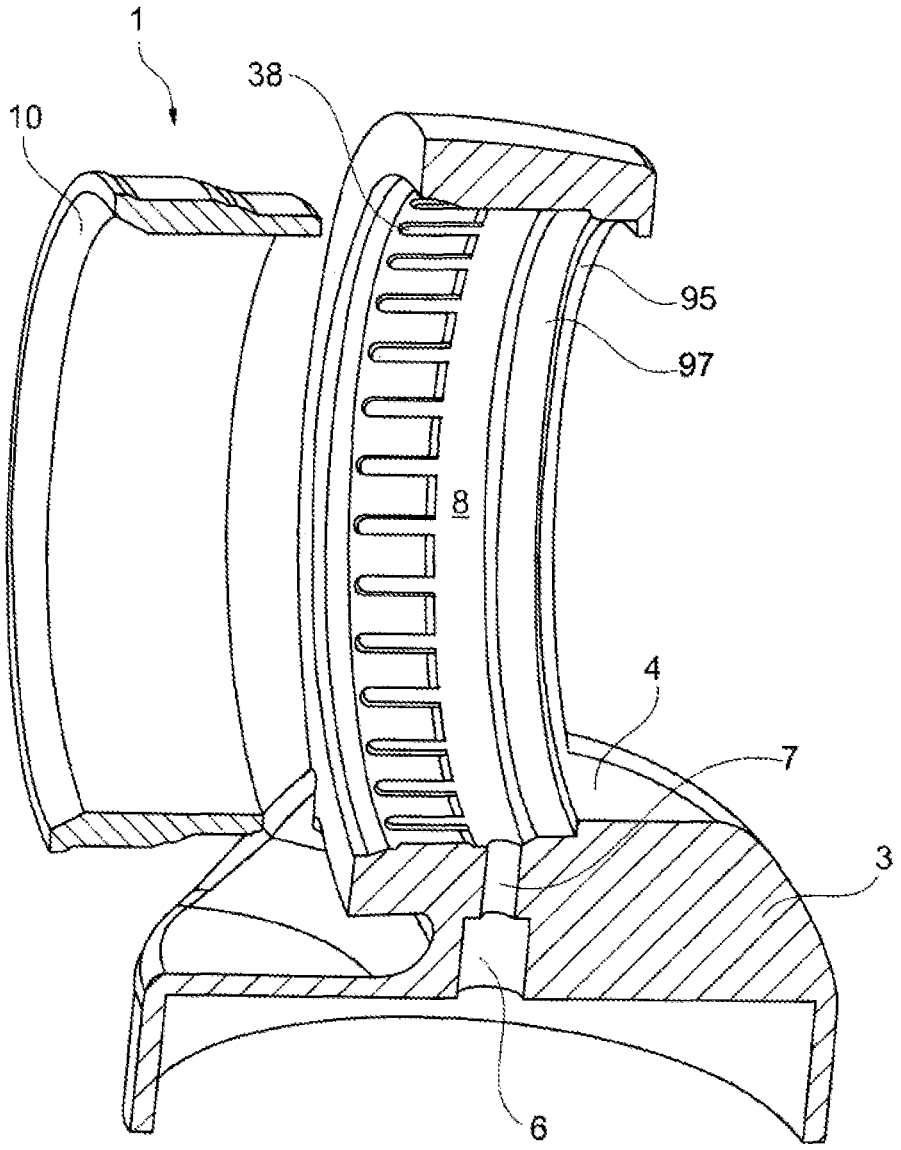

The dispensing head 1 shown in FIGS. 1 to 3 is intended to be fitted on a container (not shown) provided with a hollow valve rod or hollow pump rod, through which the product to be dispensed that is contained in the container is conveyed towards the head 1.

The container may in particular be a pressurized container of the aerosol can type, containing a propellant gas such as compressed air, for example, or a liquefied gas. The container may contain at least one cosmetic, dermatological or other compound, in particular intended for domestic application. The product may be sprayed or dispensed in some other way, in the form of a foam, for example. The proportion by weight of gas, especially in liquefied form, within the cosmetic composition may be 50% or more, and in particular lie between 50 and 60%, especially in the case of an alcohol-based cosmetic compound, or even between 70 and 80%, especially in the case of a cosmetic compound in the form of an emulsion, or even between 80 and 95%, especially in the case of an anhydrous cosmetic compound. The cosmetic compound dispensed may be a mixture of water, alcohol, oil and gas.

The container may be provided with a valve and the valve may be opened for example by pressing the hollow rod or alternatively by tilting the latter. When the container is provided with a pump, the pump may be actuated for example by pressing the hollow rod along its longitudinal axis.

The head 1 comprises a body 3 which may be produced in an integral manner by moulding a single part or may comprise a plurality of elements produced separately and joined together.

The dispensing head 1 may comprise, as can be seen in FIG. 2, a housing 6 intended to engage with the hollow rod in order to allow the product delivered through the latter to reach a supply duct 7 which opens into a housing 8 in the body 3. The housing 6 has a dimension adapted to the outside diameter of the rod, so as to obtained a sealed fit of the rod in the housing 6, in order that the product delivered through the rod passes entirely into the supply duct 7. The latter is for example coaxial with the rod of the container but could be oriented in some other way and have for example a plurality of differently oriented portions.

An engaging part 10, called core in the following text when it is inside the body, is fixed in the housing 8 and defines for example with the body 3 a dispensing orifice 12 having an annular section, as illustrated.

The expression "annular section" should be understood within the meaning of the present invention as meaning any section that follows a closed contour, whether this contour is circular, elliptical, polygonal or some other shape.

Passing axially through the core 10 is an opening 90, the inside diameter D of which may be relatively large, for example greater than or equal to 10 mm, better still 15, 20 or 30 mm.

The opening 90 helps to give the head a particularly aesthetic appearance. In addition, the opening 90 can allow air to flow through the head under the entrainment effect of a spray emitted through the dispensing orifice 12. This can help to increase the range of the spray and can increase the freshness effect provided thereby, if need be.

The opening 90 may also allow a finger or a lock of hair to be inserted through the head, and this can make it possible to apply a product in a single movement over the entire circumference of the element inserted through the head. This can be an advantage for applying for example an antiseptic or care product to a finger or for treating a lock of hair.

The dispensing axis Z may be perpendicular to the longitudinal axis X of the container on which the head is fitted, as illustrated.

The head 1 comprises a base 92 which defines a surface 4 which the user can press in order to bring about dispensing.

The bottom of the base 92 can be extended by an enclosing skirt 93 which covers the upper part of the container.

The housing 8 which receives the core 10 is defined by a crown 94 of axis Z, the lower side of which is joined to the base 92. The supply duct 7 passes through the base 92 and leads into the housing 8 at a distance from the axial ends, along the axis Z, of the crown 94, being preferably closer to the rear end 94*a* than to the front end 94*b*, as can be seen in FIG. 2.

The body 3 may have, as illustrated, a shoulder 95 close to the rear end 94*a*, against which the core 10 can come into axial abutment, if need be, at the end of its fitting.

The core 10 and the housing 8 may have annular surfaces 96 and 97, in sealed contact, in order to close the space formed between the core 10 and the body 3 at the rear of the supply duct 7.

Preferably, the circumferential width l of the dispensing orifice 12, around the spraying direction Z, is constant. If this width l varies, for example so as to take into account the possibly non-uniform pressure drop experienced by the flow of product upstream of the dispensing orifice 12, this does not depart from the scope of the present invention. This non-uniform pressure drop results for example from the geometry of the space between the core and the body, in particular the presence of angles or intersections. By varying the width l, it is possible to ensure that the product can emerge more easily at the point where this pressure drop is greatest, if a spray which is as homogeneous as possible is desired.

The width l of the dispensing orifice is for example between 0.01 and 0.15 mm for spraying a spray and 0.5 to 2 mm for dispensing a foam.

The core 10 can be fixed to the body 3 in various ways. In the example illustrated in FIGS. 1 to 3, the core 10 is retained on the body 3 by friction.

In the example illustrated, the core 10 is produced separately from the body 3 and is attached to the latter. The core 10 can be produced from the same thermoplastic material as the body 3 or alternatively from a different thermoplastic material. It is also possible to use a metal material to produce the core 10.

Figure 12A:
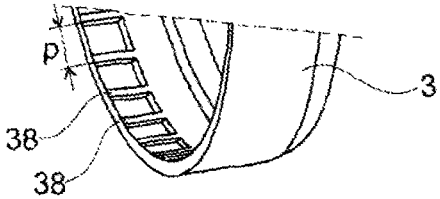
FIGS. 12A to 12C illustrate variant arrangements of the reliefs on the body.
Figure 12B:
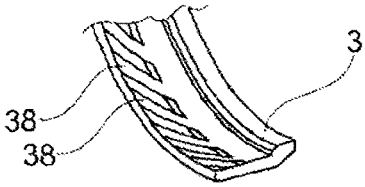
Figure 12C:
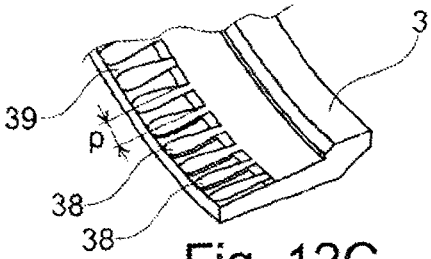

Centring reliefs 38 are formed on the internal circumference of the housing 8, as can be seen in particular in FIGS. 1 and 3, in order to centre the core 10 in the housing 8. The centring reliefs 38 may, as illustrated in FIGS. 12A to 12C, be parallel or oblique in the circumferential direction to the axis Z, or curved. Each relief 38 may have, when observed from above, a polygonal, especially rectangular or trapezoidal, outline, or be flared in the direction of the dispensing edge. Two centring reliefs 38 may define, between each other, a narrowing 39 near the dispensing orifice so as to accelerate the fluid via the Venturi effect. The number of centring reliefs 38 is preferably at least 10, better 20, and even better 40.

The space 22 formed between the core 10 and the body 3 may have the configuration illustrated schematically in FIG. 4A, and open onto the dispensing orifice 12 by way of an annular terminal portion 22*c* formed between two surfaces 3*a* and 10*a* which are in the form of cylinders of revolution about the axis Z.

The terminal wall 22*c* is attached to a proximal portion 22*a* by way of an inclined intermediate portion 22*b* formed between opposite surfaces 3*b* and 10*b*.

The centring reliefs 38 extend in the proximal portion 22*a*. The latter is supplied with product via the distribution chamber 22*d*.

When the user actuates the dispensing head 1, the product passes through the supply duct 7 into the space 22 between the core 10 and the body 3 and can be delivered in the form of a spray through the dispensing orifice 12.

In the example in FIGS. 1 to 3, the spray is continued angularly around the dispensing axis on account of the absence of contact between the core 10 and the body 3 in the region of the dispensing orifice 12. Specifically, the bearing region or regions between the core 10 and the body 3 are for example located, as illustrated, set back from the dispensing orifice 12 by a distance (measured along the dispensing axis Z) of at least 0.5 mm.

The spray may be angularly discontinuous around the distribution axis, by way of the presence, in particular level with the reliefs 38, of contact between the core 10 and the body 3 at the point where the product exits.

Preferably, the cross section of the supply duct 7 is greater than the section of the dispensing orifice 12 so as to allow the space located upstream of the dispensing orifice to be filled rapidly with the product, this being able to help to form a homogeneous spray right from the start of spraying.

The distribution chamber 22*d* formed upstream of the space 22*a* in which the centring reliefs 38 extend receives the product delivered through the supply duct 7.

The width ω of the distribution chamber 22*d* is greater than that l of the terminal portion 22*c* which opens onto the dispensing orifice 12.

The distribution chamber 22*d* improves the distribution of the product before the latter reaches the narrowest portions of the passage through which the product is evacuated.

FIGS. 4B and 4C illustrate different other examples of possible configurations for the space 22 formed between the core 10 and the body 3 for the product to flow to the dispensing orifice.

In the example in FIG. 4B, the space 22 formed between the core and the body comprises a proximal portion 22*a* in which the centring reliefs 38 of the core 10 extend in relation to the body 3, extended by an intermediate portion 22*b* which forms an angle with the spraying direction Z, for example a re-entrant angle. This intermediate portion 22*b* can be attached to a terminal portion 22*c*, which opens onto the dispensing orifice 12, this terminal portion being defined for example, as illustrated, between two surfaces 3*a* and 10*a*, in the form of cylinders of revolution, parallel to the dispensing direction Z. The variant in FIG. 4B does not have a distribution chamber.

In the variant in FIG. 4C, the terminal portion 22*c* communicates directly with that portion 22*a* in which the centring reliefs 38 extend. The terminal portion 22*c* forms, for example, an angle with the dispensing direction Z. Thus, in axial half section, the axis $Z_1$ of the orifice 12 is for example convergent, as illustrated.

Figure 4E:
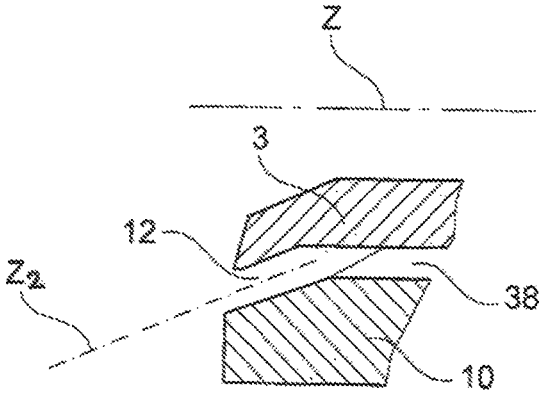
Figure 4D:
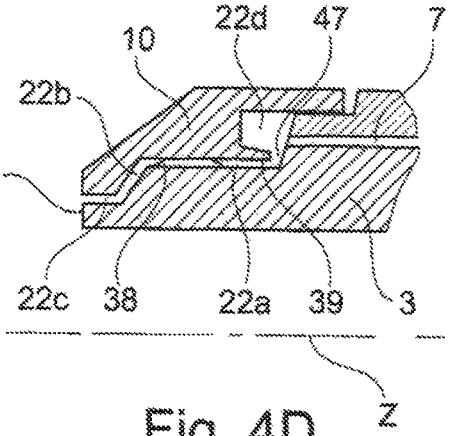

In the variant in FIG. 4D, the engaging part 10 is outside the body 3. The engaging part 10 is fixed to the body 3 so as to form with the latter the distribution chamber 22*d*, facing the supply duct 7. The portions 22*a*, 22*b* and 22*c* allow the product to be conveyed to the dispensing orifice 12.

The supply duct 7 opens for example into the distribution chamber 22*d* via a portion oriented parallel to the dispensing axis Z.

Centring reliefs 38 are produced for example on the body 3. The engaging part 10 can be produced, as illustrated, with an annular lip 39 which partially delimits the distribution chamber 22*d* and forms a narrowing 47 of the section between the chamber 22*d* and the portion 22*a*.

FIG. 4E illustrates the possibility of having an angle which is divergent between the axis $Z_2$, in axial half section, of the orifice 12 and the dispensing axis.

Figure 4F:
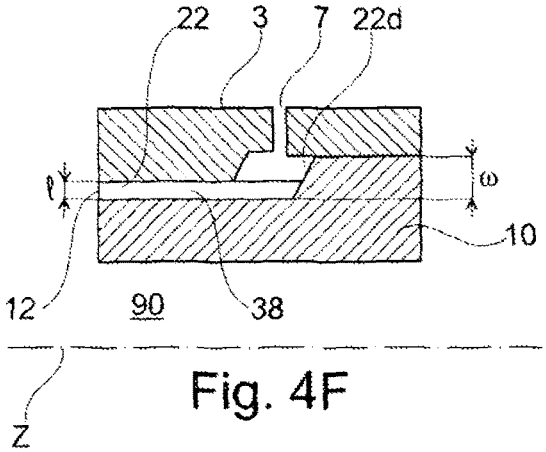

In the variant shown in FIG. 4F, the possibility of having no angle between the dispensing axis and the axis Z of the engaging part 10 is illustrated. The supply duct 7 for example opens onto a distribution chamber 22*d*. The product is conveyed towards the dispensing orifice 12 via ducts 22 comprising reliefs 38. The reliefs 38 extend as far as the edge of the dispensing orifice 12 and define a plurality of orifices allowing the product to be delivered in the form of a plurality of jets.

The invention is not limited to a dispensing head comprising only one dispensing orifice 12 produced in accordance with the invention.

By way of example, FIG. 5 illustrates a dispensing head 1 which comprises two dispensing orifices 12.

When there are a plurality of dispensing orifices, these may be distributed in multiple ways on the dispensing head. For example, the spraying axes are parallel, or form an angle, in that, for example, they intersect.

Figure 8B:
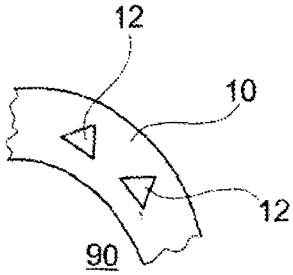

FIGS. 7, 8A and 8B illustrate the possibility of the dispensing head having a plurality of dispensing orifices 12 entirely formed in the core 10 in order to dispense the product in the form of a plurality of jets for example. The dispensing orifices 12 may have many shapes when observed along their transverse axis, especially being circular or triangular, as illustrated in FIGS. 8A and 8B. The dispensing orifices 12 may be cut into the core 10, for example by laser cutting.

The core 10 may have a U-shaped axial half-section, as illustrated in FIG. 7. The body 3 may comprise two concentric mounting skirts 41, which define between them a space for mounting the core 10, and comprise, in its centre, a crown 43 serving to support the engaging part 10. The skirts 41 define, with the crown 43, two annular ducts 45 into which the arms of the U fit. The crown 43 may have, for each orifice 12, two ducts 22 for supplying liquid to this orifice 12.

Figure 14:
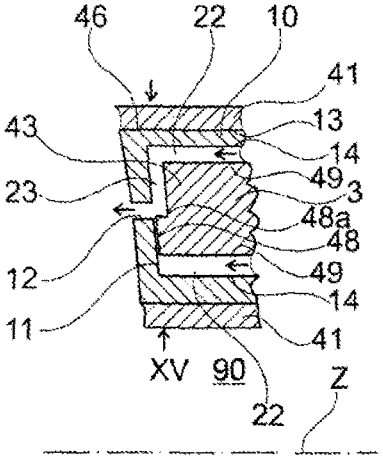
FIG. 14 is a partial axial cross section of a variant embodiment of the dispensing orifice.
Figure 15:
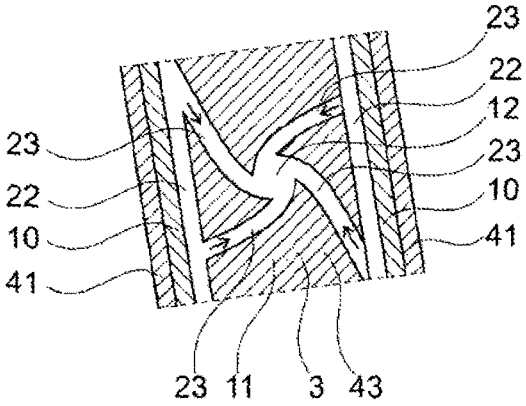
FIG. 15 is a cross section along XV in FIG. 14.
Figure 16:
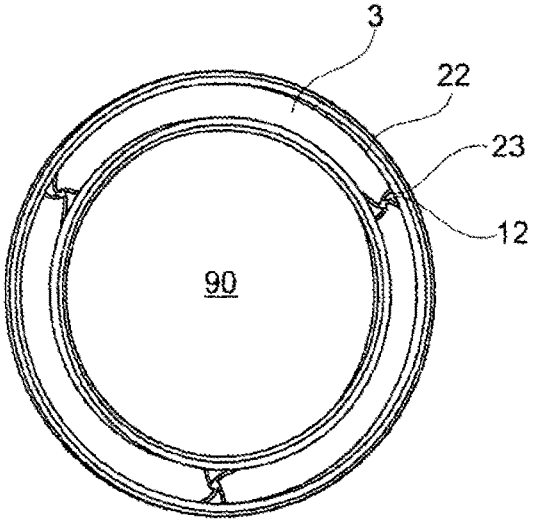
FIG. 16 is an embodiment of the body in accordance with FIG. 14.
Figure 17:
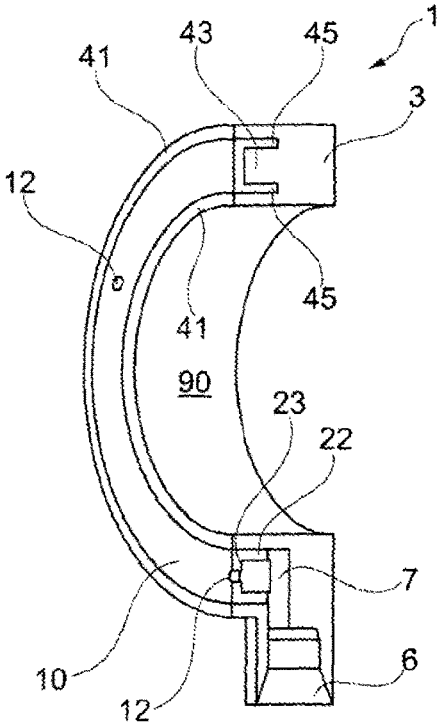
FIG. 17 is a perspective cross-sectional view of an example of a dispensing head according to the configuration in FIG. 14.

During mounting, as illustrated in FIGS. 14 and 17, the core 10 may bear against the pad 43, the end face 48 of the crown 43 making contact with the inner face 11 of the core 10. The arms of the U of the core 10 are fixed in the ducts 45, the inner face 46 of the mounting skirts 41 making contact with the face 13 of the core 10. The inner faces 14 of the arms of the U and the lateral surfaces 49 of the crown 43 may define, between one another, the ducts 22 for supplying liquid to the dispensing orifice 12. The crown 43 may possess, especially in the form of impressions, on its outer face 48, supply ducts 23 allowing the liquid to pass from the supply ducts 22 to the dispensing orifice 12.

The supply ducts 22 open, upstream of the dispensing orifices 12, onto the supply ducts 23, which lead to the dispensing orifice 12. The supply ducts 23 generate, via their orientation relative to the dispensing orifice, a swirling flow at the outlet of the dispensing orifice 12. This configuration is more particularly useful in the case of a non-liquefied carrier gas.

In one variant, the supply ducts 22 may take the form of impressions in the lateral surface 49 of the body and/or the inner faces 14 of the core 10.

In another variant, the core 10 possesses, especially in the form of impressions on its inner face 11, supply ducts 23, the outer face 48 of the crown 43 possibly being smooth.

In a variant, the crown 43 is not circumferentially continuous and defines pads. The pads are placed upstream of the dispensing orifices 12 and may possess, upstream of the dispensing orifices 12, supply ducts 22 and 23 such as described above.

Figure 10B:
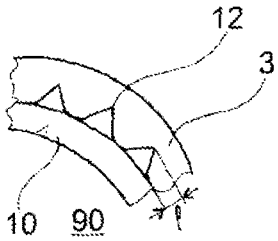

In the variant shown in FIGS. 4F, 9 and 10, the dispensing orifices 12 are formed between the core 10 and the body 3, being, for example, distributed all around the spraying axis Z. The core 10 or the body 3 may have centring reliefs 38 that circumferentially bound the dispensing orifices 12. The centring reliefs 38 may, as illustrated in FIGS. 12A to 12C, extend as far as the edge of the core 10 over its entire periphery and define, between one another, dispensing orifices 12. The number of dispensing orifices 12 is preferably at least 10, better 20 and even better 40. The cross-sectional area of a dispensing orifice 12 is for example greater than 0.003 $mm^2$. The dispensing orifices 12 are preferably spaced apart by a space of at least 1 mm, which is the same as the pitch p between the centring reliefs. As illustrated in FIGS. 10A and 10B, the dispensing orifices 12 can have a polygonal cross section, especially a triangular cross section.

Figures 13A, 13B, 13C:
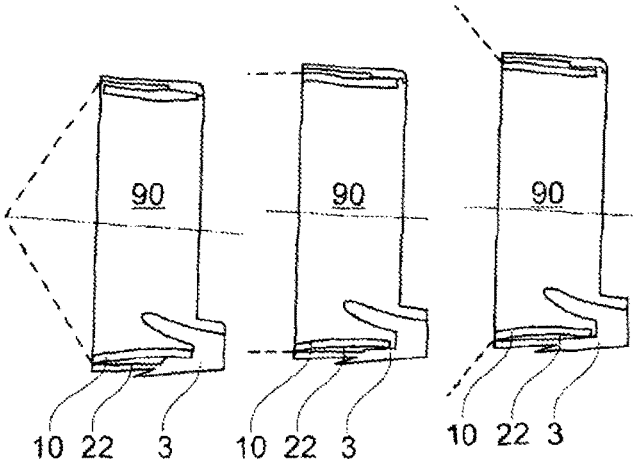
FIGS. 13A to 13C illustrate variant configurations of the engaging part relative to the body.

The core 10 may, as illustrated in FIG. 13A, be set back relative to the body by an amount lying between 0 and 1 mm, better still between 0 and 0.5 mm. The body 3 protrudes into the dispensing orifice and may generate a convergent spray.

The core 10 may, as illustrated in FIG. 13B, lie flush with the body 3. The spray may then be straight.

The core 10 may extend, as illustrated in FIG. 13C, forwards, relative to the body 3, by an amount lying between 0 and 1 mm, better still between 0 and 0.5 mm. The spray may then diverge.

If an additional dispensing orifice is provided, for example by attaching inside the core 10 a second core 50 which defines with the first core 10 a second dispensing orifice 51 which is coaxial with the first dispensing orifice, as illustrated in FIG. 6, this does not depart from the scope of the present invention. A passage 90 continues to be formed through the dispensing head.

The dispensing orifice may be supplied with more than one product.

The dispensing head may be supplied with two products which are dispensed through separate dispensing orifices.

Figure 11:
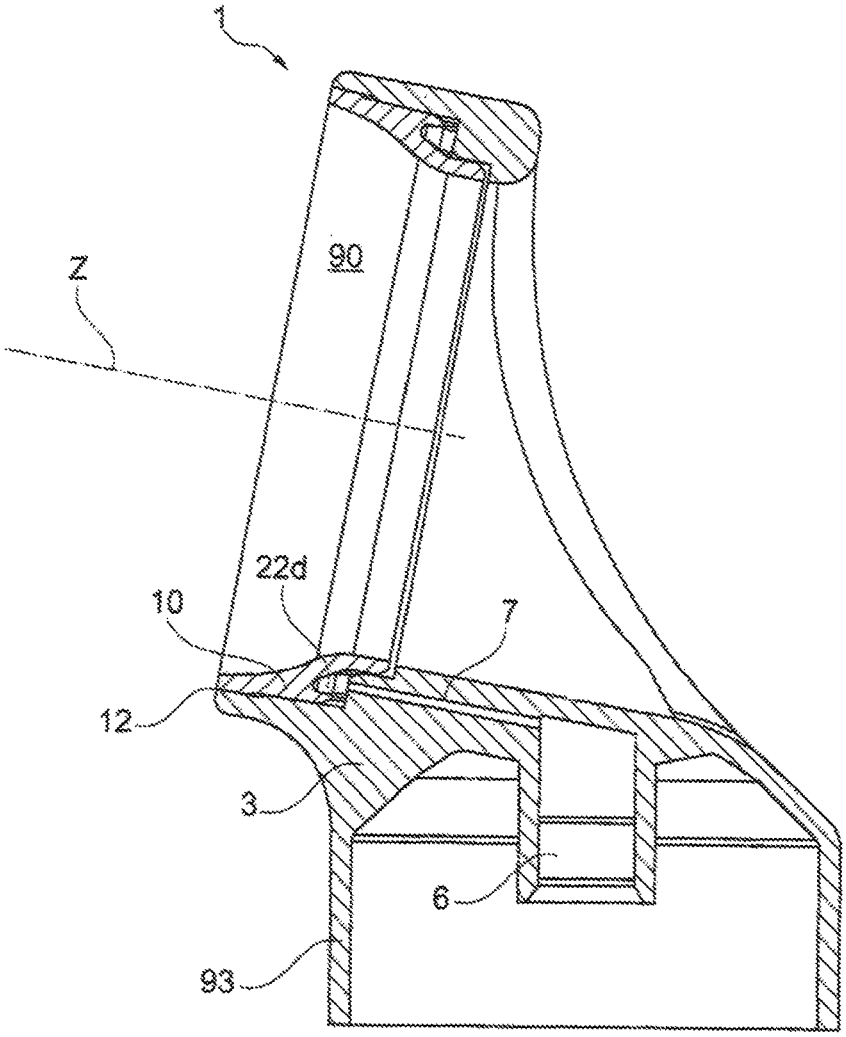
FIG. 11 is a view similar to FIG. 2 of a variant embodiment of the head.

It is possible for the axis Z not to be perpendicular to the axis of the rod of the container on which the head is fitted, as illustrated in FIG. 11. In this example, the axis Z is oriented upwards when the container is vertical with the dispensing head at the top.

The supply duct 7 can be oriented substantially parallel to the dispensing axis Z, at least in the case of the portion which opens out next to the engaging part 10. The latter may be produced with an annular lip 39 which defines a narrowing of the section 47.

The configuration may be similar to that in FIG. 4D apart from the fact that the engaging part 10 is outside the body 3 in the example in FIG. 4D and inside it in the example in FIG. 11.

The dispensing head may be arranged so as to allow a protective cap to be fitted and to comprise, if need be, an on/off system that makes it possible to prevent the actuation of the device when the dispensing head is in a certain position with respect to the container or when a locking element of the dispensing head is in a certain position in relation to the latter.

The product to be sprayed may be a deodorant, in particular a deodorant that contains an alcohol, an antiperspirant, a hair-care product, a shaving foam, among other possibilities.

In variants which are not illustrated, the dispensing orifice is formed between a body and an engaging part, the body being radially on the inside with respect to the engaging part, the supply duct for the product passing through the body. All of the features described with reference to the figures can be found in variants in which the body is radially on the inside with respect to the engaging part.

The expression "comprising a" should be understood as being synonymous with "comprising at least one".

The invention claimed is:

1. A container containing a cosmetic product and provided with a dispensing head for dispensing the cosmetic product, the dispensing head comprising:

a body having a crown of annular shape extending along a dispensing axis, the body being open at its two opposite axial ends in the dispensing head; and an engaging part extending along the dispensing axis and being open at its two opposite axial ends in the dispensing head, the engaging part at least partially defining a dispensing orifice for dispensing the cosmetic product, the engaging part being inserted into the crown.

2. The container according to claim 1, the dispensing orifice being annular and preferably having, in the circumferential direction, a constant width (l).

3. The container according to claim 1, the dispensing orifice being axially symmetric.

4. The container according to claim 1, the engaging part defining at least in part a plurality of dispensing orifices.

5. The container according to claim 4, the number of dispensing orifices being 10 or more.

6. The container according to claim 4, each of the dispensing orifices having a cross-sectional area of 0.003 $mm^2$ or more.

7. The container according to claim 4, the dispensing orifices being spaced apart by a space of more than 1 mm.

8. The container according to claim 4, the dispensing orifices being entirely formed in the engaging part.

9. The container according to claim 8, the dispensing orifices being constructed in such a way that a jet exiting from each orifice swirls.

10. The container according to claim 4, the number of dispensing orifices being 20 or more.

11. The container according to claim 4, the number of dispensing orifices being 40 or more.

12. The container according to claim 1, the dispensing orifice being defined between the engaging part and the body.

13. The container according to claim 1, a distribution chamber being formed between the engaging part and the body upstream of the dispensing orifice, a supply duct for the product opening into the distribution chamber.

14. The container according to claim 1, a width of a space between the engaging part and the body decreasing towards the dispensing orifice.

15. The container according to claim 1, a width of a space between the engaging part and the body increasing towards the dispensing orifice.

16. The container according to claim 1, comprising surfaces parallel to a dispensing axis, defining a passage that opens onto the dispensing orifice.

17. The container according to claim 1, at least one of the body and the engaging part having at least one centring relief for centring the engaging part in a housing in the body, the at least one centring relief being produced on the body.

18. The container according to claim 17, the at least one centring relief being located set back from the dispensing orifice.

19. The container according to claim 17, the at least one centring relief comprising a plurality of centring reliefs extending as far as an edge of the dispensing orifice so as to generate a multitude of orifices via which jets of product exit, the plurality of centring reliefs being oriented parallel to a dispensing axis or obliquely in the same circumferential direction around the axis.

20. The container according to claim 1, an inlet of the product into a space defined between the engaging part and the body takes place through a supply duct having a section greater than that of the dispensing orifice.

21. The container according to claim 1, comprising a passage that extends through the engaging part and the body, having a diameter greater than or equal to 10 mm.

22. The container according to claim 1, the dispensing orifice being annular and having a width of between 0.01 and 0.15 mm for dispensing a spray.

23. The container according to claim 1, the dispensing orifice having, in an axial sectioning half plane, an axis that converges in relation to a spraying direction.

24. The container according to claim 1, the dispensing orifice having, in an axial sectioning half plane, an axis that diverges in relation to a spraying direction.

25. The container according to claim 1, the engaging part lying flush with a front end of the body.

26. The container according to claim 1, the engaging part being axially set back from a front end of the body.

27. The container according to claim 1, the engaging part extending axially beyond a front end of the body.

28. The container according to claim 1, comprising a plurality of dispensing orifices produced in the engaging part, the latter having a U-shaped axial half-section, the body having two concentric mounting skirts between which the engaging part is fastened.

29. The container according to claim 1, the container being a pressurized container.

30. The container according to claim 1, the crown bearing one or more reliefs defining, with the engaging part, swirl ducts.

31. The container according to claim 1, the dispensing orifice being rotationally symmetric.

32. The container according to claim 1, the dispensing orifice being annular and having a width from 0.5 to 2 mm for dispensing a foam.

33. The container according to claim 1, wherein the cosmetic product is chosen from the group consisting of a deodorant, an antiperspirant, a hair-care product, and a shaving foam.

34. A dispensing head intended to be fitted on a container that contains at least one cosmetic product to be dispensed, the dispensing head comprising:

a body that is open at its two opposite axial ends, an engaging part that is open at its two opposite axial ends, at least partially defining a dispensing orifice, at least one of the body and the engaging part having a plurality of centring reliefs for centring the engaging part in a housing in the body, the centring reliefs extending as far as an edge of the dispensing orifice so as to generate a multitude of orifices via which jets of product exit, the centring reliefs especially being oriented parallel to a dispensing axis or obliquely in the same circumferential direction around the axis, the centring reliefs defining, between one another, sectional narrowings that cause the jets of product to be accelerated.

35. The head according to claim 34, the centring reliefs being produced on the body.

36. A container containing a cosmetic product and provided with a dispensing head for dispensing the cosmetic product, the dispensing head comprising:

a body that is open at its two opposite axial ends, an engaging part that is open at its two opposite axial ends, the engaging part at least partially defining a dispensing orifice for dispensing the cosmetic product, and a distribution chamber being formed between the engaging part and the body upstream of the dispensing orifice, a supply duct for the product opening into the distribution chamber.

37. A container containing a cosmetic product and provided with a dispensing head for dispensing the cosmetic product, the dispensing head comprising:

a body that is open at its two opposite axial ends, and an engaging part that is open at its two opposite axial ends, the engaging part at least partially defining a dispensing orifice for dispensing the cosmetic product, at least one of the body and the engaging part having at least one relief for centring the engaging part in a housing in the body, the at least one relief extending as far as an edge of the dispensing orifice so as to generate a multitude of orifices via which jets of product exit.

38. The container according to claim 37, the at least one relief being disposed on the body.

39. The container according to claim 37, the at least one relief being oriented parallel to a dispensing axis or obliquely in the same circumferential direction around the axis.

40. A container containing a cosmetic product and provided with a dispensing head for dispensing the cosmetic product, the dispensing head comprising:

a body that is open at its two opposite axial ends, an engaging part that is open at its two opposite axial ends, the engaging part at least partially defining a dispensing orifice for dispensing the cosmetic product, and a plurality of dispensing orifices disposed in the engaging part, the engaging part having a U-shaped axial half-section, and the body having two concentric mounting skirts between which the engaging part is fastened.

41. The container according to claim 40, the body comprising a crown into which the engaging part is inserted.

42. The container according to claim 41, the crown bearing one or more reliefs defining, with the engaging part, swirl ducts.

* * * * *